US008961381B2

(12) United States Patent
Walraven et al.

(10) Patent No.: US 8,961,381 B2
(45) Date of Patent: Feb. 24, 2015

(54) DUAL FEED CENTRIFUGE

(75) Inventors: Albert Walraven, Dubai (AE); Bradley N. Jones, Walton, KY (US); Leonardo Renzo Vicentini, Berra (IT)

(73) Assignee: M-I L.L.C., Houston, TX (US)

( * ) Notice: Subject to any disclaimer, the term of this patent is extended or adjusted under 35 U.S.C. 154(b) by 1100 days.

(21) Appl. No.: 12/995,906

(22) PCT Filed: Jun. 5, 2009

(86) PCT No.: PCT/US2009/046445

§ 371 (c)(1),
(2), (4) Date: Dec. 2, 2010

(87) PCT Pub. No.: WO2009/149373

PCT Pub. Date: Dec. 10, 2009

(65) Prior Publication Data

US 2011/0105292 A1 May 5, 2011

Related U.S. Application Data

(60) Provisional application No. 61/059,532, filed on Jun. 6, 2008.

(51) Int. Cl.
*B04B 1/20* (2006.01)
*B04B 11/02* (2006.01)

(52) U.S. Cl.
CPC . *B04B 1/20* (2013.01); *B04B 11/02* (2013.01); *B04B 2001/2033* (2013.01)
USPC ..... 494/37; 494/53

(58) Field of Classification Search
CPC ..... B04B 11/02; B04B 1/20; B04B 2001/20
USPC ..... 494/37, 53, 54; 210/380.1, 380.3
See application file for complete search history.

(56) References Cited

U.S. PATENT DOCUMENTS 2,596,616 A * 5/1952 Strezynski ..... 494/27
2,837,272 A * 6/1958 Laguilharre ..... 494/27

(Continued)

FOREIGN PATENT DOCUMENTS

DE 102006056934 A1 * 6/2008 ..... B04B 1/20
EP 156311 A2 * 10/1985 ..... B04B 1/20

(Continued)

OTHER PUBLICATIONS

Second Examiner's Report issued Jul. 30, 2013 in corresponding Canadian application No. 2,726,980 (3 pages).

(Continued)

*Primary Examiner* — Charles Cooley
(74) *Attorney, Agent, or Firm* — Osha Liang LLP

(57) ABSTRACT

A dual feed centrifuge system for separating solids from fluids in a drilling mud, the centrifuge system including: a bowl; a screw conveyor rotatably mounted within the bowl; a first feed pipe mounted within the screw conveyor for feeding a drilling mud through a first feed port in a wall of the screw conveyor to a first annular space between the bowl and the wall of the screw conveyor; and a second feed pipe mounted within the screw conveyor for feeding a drilling mud through a second feed port in the wall of the screw conveyor to a second annular space between the bowl and the wall of the screw conveyor. The multiple feed ports may allow the centrifuge to operate more efficiently with both weighted and unweighted drilling fluids.

23 Claims, 5 Drawing Sheets

(56) References Cited

U.S. PATENT DOCUMENTS

| | | | | | |
|---|---|---|---|---|---|
| 2,895,669 | A | * | 7/1959 | Bobo | 494/10 |
| 3,200,068 | A | * | 8/1965 | Jonakin et al. | 210/702 |
| 3,228,594 | A | * | 1/1966 | Amero | 494/23 |
| 3,405,866 | A | * | 10/1968 | Amero | 494/27 |
| 3,532,264 | A | * | 10/1970 | Amero | 494/6 |
| 3,967,778 | A | * | 7/1976 | Hunwick | 494/29 |
| 3,971,509 | A | * | 7/1976 | Johnsen | 494/27 |
| 4,190,194 | A | * | 2/1980 | Amero | 494/27 |
| 4,298,160 | A | * | 11/1981 | Jackson | 494/27 |
| 4,378,906 | A | * | 4/1983 | Epper et al. | 494/54 |
| 4,451,247 | A | * | 5/1984 | Ostkamp et al. | 494/52 |
| 4,509,942 | A | * | 4/1985 | Gunnewig | 494/53 |
| 4,582,597 | A | | 4/1986 | Huber | |
| 4,743,226 | A | * | 5/1988 | Day et al. | 494/53 |
| 5,614,094 | A | | 3/1997 | Deister et al. | |
| 6,368,264 | B1 | * | 4/2002 | Phillips et al. | 494/5 |
| 7,337,860 | B2 | | 3/2008 | McIntyre | |
| 2004/0225148 | A1 | * | 11/2004 | Isogai et al. | 562/412 |
| 2005/0194853 | A1 | | 9/2005 | Fout et al. | |
| 2006/0105896 | A1 | * | 5/2006 | Smith et al. | 494/7 |
| 2007/0087927 | A1 | * | 4/2007 | Scott et al. | 494/7 |
| 2007/0131592 | A1 | | 6/2007 | Browne et al. | |
| 2011/0105292 | A1 | * | 5/2011 | Walraven et al. | 494/5 |

FOREIGN PATENT DOCUMENTS

| | | | | | | |
|---|---|---|---|---|---|---|
| FR | 1587743 | | * | 3/1970 | | |
| JP | 61071856 | A | * | 4/1986 | | B04B 1/20 |
| JP | 63194760 | A | * | 8/1988 | | B04B 1/20 |
| JP | 01151958 | A | * | 6/1989 | | B04B 1/20 |
| JP | 01189358 | A | * | 7/1989 | | B04B 1/20 |
| JP | 02017956 | A | * | 1/1990 | | B04B 1/20 |
| JP | 6-41000 | | * | 9/1994 | | |
| JP | 9-066299 | A | | 3/1997 | | |
| JP | 09066299 | A | * | 3/1997 | | C02F 11/14 |
| JP | 09201550 | A | * | 8/1997 | | B04B 1/20 |
| JP | 10-128155 | A | | 5/1998 | | |
| JP | 2001-149813 | | * | 6/2001 | | |
| JP | 2003-146939 | A | | 5/2003 | | |
| JP | 2010-264417 | | * | 11/2010 | | |
| JP | 2012-115814 | | * | 9/2012 | | |
| WO | 2009149373 | A2 | | 12/2009 | | |

OTHER PUBLICATIONS

First Examiner's Report issued Sep. 24, 2012 in corresponding Canadian application No. 2,726,980 (3 pages).

Notification of Grant / Notification of Completion of Formalities (w/translation) issued Nov. 5, 2013 in corresponding Chinese application No. 200980128325.5 (4 pages).

International Search Report issued in PCT/US2009/046445, mailed on Jan. 15, 2010, 3 pages.

Written Opinion issued in PCT/US2009/046445, mailed on Jan. 15, 2010, 4 pages.

First Office Action dated Jun. 7, 2013 (and letter reporting same) issued in corresponding Mexican application No. MX/a/2010/013266 (9 pages).

Second Office Action dated May 21, 2013 (w/translation) issued in corresponding Chinese application No. 200980128325.5 (9 pages).

Correspondence reporting an Official Action issued Jan. 30, 2014 in corresponding Mexican application No. MX/a/2011/009018 (8 pages).

First Office Action dated Aug. 31, 2012 (and letter reporting same) issued in corresponding Chinese application No. 200980128325.5 (13 pages).

Fourth Examiner's Report issued Dec. 9, 2014 in corresponding Canadian application No. 2,726,980 (3 pages).

* cited by examiner

DUAL FEED CENTRIFUGE

BACKGROUND OF DISCLOSURE

1. Field of the Disclosure

Embodiments disclosed herein relate generally to a centrifuge system for processing a fluid including solids and liquids. In another aspect, embodiments disclosed herein relate to a dual feed centrifuge system for removing solids from a fluid material. In another aspect, embodiments disclosed herein relate to a dual feed centrifuge system for removing solids from a drilling fluid material. In yet another aspect, embodiments disclosed herein relate to a method of separating solids from liquids in a fluid material using a dual feed centrifuge.

2. Background

Oilfield drilling fluid, often called "mud," is typically a liquid having solids suspended therein. In general, the solids function to impart desired density and rheological properties to the drilling mud. The drilling mud can also contain undesired solids in form of drill cuttings from the downhole drilling operation that require separation.

Drilling muds may contain polymers, biopolymers, clays and organic colloids added to an oil-based or a water-based fluid to obtain the required viscosity and filtration properties. Heavy minerals, such as barite or calcium carbonate, may be added to increase density.

The drilling mud serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures, thereby preventing fluids from blowing out if pressurized deposits in the formation are breached. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents, as mentioned above, are mixed into the drilling mud to obtain the right mixture. Typically, drilling mud weight is reported in "pounds," short for pounds per gallon. Increasing the amount of weighting agent solute dissolved in the mud base will generally create a heavier drilling mud. Drilling mud that is too light may not protect the formation from blow outs, and drilling mud that is too heavy may over-invade the formation. Thus, a drilling mud can be referred to as weighted or un-weighted, depending upon the amount of weighting agent and other additives contained therein.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling mud exiting the nozzles at the bit acts to stir-up and carries the solid particles of rock and formation to the surface. Therefore, the drilling mud exiting the borehole from the annulus is a slurry containing formation cuttings.

Before the drilling mud can be recycled and re-pumped down through nozzles of the drill bit, certain solids, for example, the drill cuttings, must be removed. In general, the drilling solids can be separated from the drilling mud using various combinations of shale shakers, centrifuges and mud tanks.

One type of apparatus used to remove cuttings and other solid particulates from drilling mud is commonly referred to in the industry as a "shale shaker." A shale shaker, also known as a vibratory separator, is a vibrating sieve-like table upon which returning used drilling mud is deposited and through which substantially cleaner drilling mud emerges.

In some cases, the drilling mud fluid recovered from the shale shaker may be free from large drill cuttings and can be sent to a mud tank for further separation and processing. For example, the residual fluid can be further processed to form drilling mud for downhole reinjection. However, in other cases, the fluid effluent from the shale shaker may require further solids separation, such as to adjust the levels of or recover various additives from the drilling mud. Such further separation can be accomplished using a centrifuge.

The principle of the centrifuge operation relies upon the density difference between the solids and the liquids within the drilling mud. As a rotational torque is applied to a centrifuge generating a centrifugal force (hereinafter, "G force"), the higher-density solids preferentially accumulate on the outer periphery inside the centrifuge, whereas the lower-density liquids preferentially accumulate closer to the axis of the centrifuge rotation. Upon the initial separation by the G force, the solids and the liquids can be removed from opposite sides of the centrifuge using a ribbon-type screw conveyor, sometimes referred to as a scroll.

Referring to FIG. 1, a conventional centrifuge, such as that disclosed in U.S. Pat. App. Publ. No. 2006/0105896 A1, is illustrated. Centrifuge 10 has a bowl 12, supported for rotation about a longitudinal axis, wherein a large bowl section 12*d* has an open end 12*b*, and a conical section 12*e* has an open end 12*a*, with the open end 12*a* receiving a drive flange 14 which is connected to a drive shaft (not illustrated) for rotating the bowl 12. The drive flange 14 has a single longitudinal passage which receives a feed pipe 16 for introducing a drilling mud feed into the interior of the bowl 12. A screw conveyor 18 extends within the bowl 12 in a coaxial relationship thereto and is supported for rotation within the bowl 12. A hollow flanged shaft 19 is disposed in the end 12*b* of the bowl and receives a drive shaft 17 of an external planetary gear box for rotating the screw conveyor 18 in the same direction as the bowl 12 at a selected speed.

The wall of the screw conveyor 18 has a feed port 18*a* near the outlet end of the feed pipe 16 so that the centrifugal forces generated by the rotating bowl 12 move the drilling mud radially outward through the feed port 18*a* into the annular space between the screw conveyor 18 and the bowl 12. The annular space can be located anywhere along the large bowl section 12*d* or the conical section 12*e* of bowl 12. The fluid portion of the drilling mud is displaced toward the end 12*b* of the bowl 12 and recovered through one or more fluid discharge ports 19*c*. The entrained solids in the drilling mud slurry settle toward the inner surface of the bowl 12 due to the G forces generated, and are scraped and displaced by the screw conveyor 18 toward the end 12*a* of the bowl for discharge through a plurality of solids discharge ports 12*c* formed through the wall of the bowl 12 near its end 12*a*. The centrifuge 10 is enclosed in a housing or casing (not shown) in a conventional manner.

The main challenges facing the operation of a centrifuge include high feed rates and varying solids content in the feed.

As the feed rates increase, high torque is typically required to accomplish the solids separation, thus resulting in increased costs due to equipment size, duplication, and increased energy costs. Additionally, feed inconsistencies due to variations in the solids content require constant torque adjustment, thus resulting in accelerated equipment wear and tear.

There is still a significant need in the art for improved centrifuge devices and methods for more cost-efficient solids separation from drilling muds that can handle high feed rates and varying solids content in the feed.

SUMMARY OF THE DISCLOSURE

In one aspect, embodiments disclosed herein relate to a dual feed centrifuge system for separating solids from fluids in a drilling mud, the centrifuge system including: a bowl; a screw conveyor rotatably mounted within the bowl; a first feed pipe mounted within the screw conveyor for feeding a drilling mud through a first feed port in a wall of the screw conveyor to a first annular space between the bowl and the wall of the screw conveyor; and a second feed pipe mounted within the screw conveyor for feeding a drilling mud through a second feed port in the wall of the screw conveyor to a second annular space between the bowl and the wall of the screw conveyor.

In another aspect, embodiments disclosed herein relate to a process for separating solids from fluids in a drilling mud including: feeding a drilling mud through at least one of a first feed pipe and a second feed pipe to a centrifuge, the centrifuge having: a bowl; a screw conveyor rotatably mounted within the bowl; the first feed pipe mounted within the screw conveyor for feeding the drilling mud through a first feed port in a wall of the screw conveyor to a first annular space between the bowl and the wall of the screw conveyor; and the second feed pipe mounted within the screw conveyor for feeding the drilling mud through a second feed port in the wall of the screw conveyor to a second annular space between the bowl and the wall of the screw conveyor; separating the drilling mud into a solid and a fluid, the separating comprising: rotating the bowl with a speed A using a rotation device, wherein the solid accumulates along the bowl; rotating the screw conveyor with a speed B using a rotating device, wherein the fluid moves along the screw conveyor; moving the solid along the bowl using the screw conveyor; recovering the solid through a solid discharge port; and recovering the fluid through a fluid discharge port.

In another aspect, embodiments disclosed herein relate to a method for separating solids from fluids, the method including: feeding a first drilling mud via a first feed pipe to a centrifuge, the centrifuge having: a bowl; a screw conveyor rotatably mounted within the bowl; a first feed port in a wall of the screw conveyor; and a second feed port in the wall of the screw conveyor; wherein the first feed pipe is mounted within the screw conveyor for feeding the drilling mud through the first feed port to an annular space between the bowl and the wall of the screw conveyor; and feeding a second drilling mud via a second feed pipe to the centrifuge, wherein the second feed pipe is mounted within the screw conveyor for feeding the drilling mud through the second feed port to the annular space between the bowl and the wall of the screw conveyor.

In another aspect, embodiments disclosed herein relate to a dual feed centrifuge system for separating solids from fluids in a drilling mud, the centrifuge system including: a bowl; a screw conveyor rotatably mounted within the bowl; a first feed pipe mountable within the screw conveyor for feeding a drilling mud through a first feed port in a wall of the screw conveyor to a first annular space between the bowl and the wall of the screw conveyor; and a second feed pipe mountable within the screw conveyor for feeding a drilling mud through a second feed port in the wall of the screw conveyor to a second annular space between the bowl and the wall of the screw conveyor.

Other aspects and advantages will be apparent from the following description and the appended claims.

DETAILED DESCRIPTION

Figure 1:
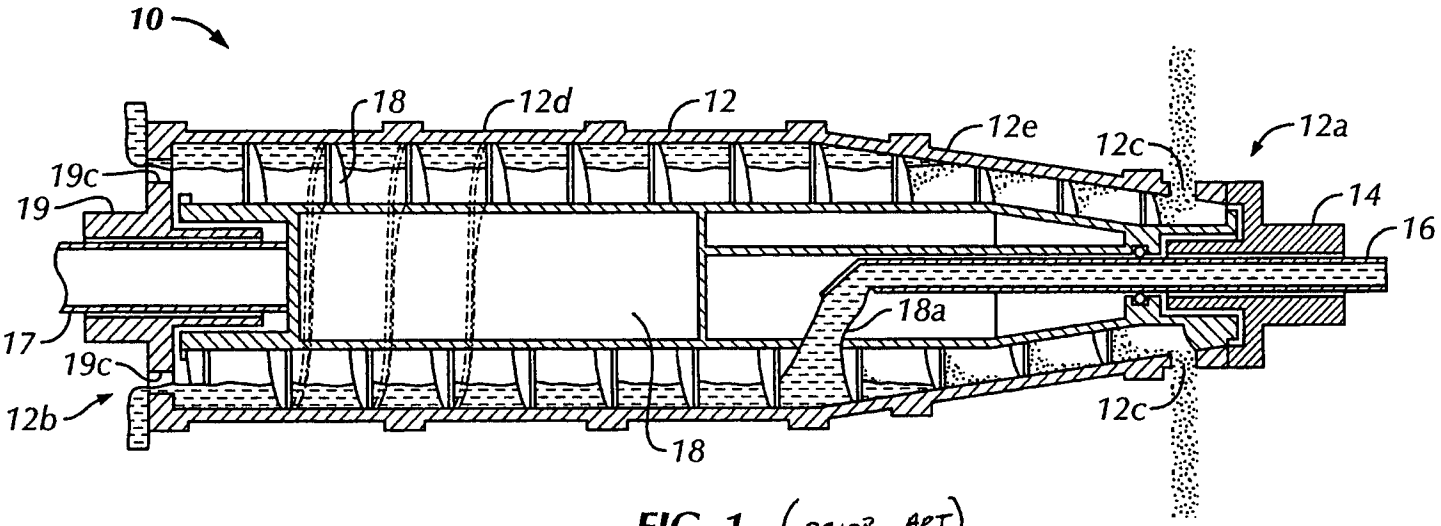
FIG. 1 (PRIOR ART)
FIG. 1 is a schematic of a prior art centrifuge.

In one aspect, embodiments disclosed herein relate to a centrifuge system for processing a fluid including solids and liquids. In another aspect, embodiments disclosed herein relate to a dual feed centrifuge system for separating and removing solids from a fluid material. In another aspect, embodiments disclosed herein relate to a dual feed centrifuge system for separating and removing solids from a drilling fluid material. In yet another aspect, embodiments disclosed herein relate to a method of separating and removing solids from liquids in a fluid material using a dual feed centrifuge. In yet another aspect, embodiments herein relate to a system and a method of controlling the flow to a dual feed centrifuge system based on a fluid property.

As used in embodiments disclosed herein, "drilling mud" refers to a mixture having a fluid and a solid suspended therein. The fluid may be either oil-based or water-based. Solids may include one or more of drill cuttings, additives, or weighting agents. For example, the drilling mud may contain polymers, biopolymers, clays and organic colloids added to oil-based or water-based fluids in order to obtain the required density, viscosity and filtration properties. In other embodiments, the drilling mud may contain heavy minerals, for example, barite or calcium carbonate that may be added to increase density. In yet other embodiments, the drilling mud may contain solids from the drilling formation that become dispersed in the mud as a consequence of drilling.

As used in embodiments disclosed herein, "weighted" and "un-weighted" refer to the relative amount of additives and weighting agents that are dissolved, suspended, or otherwise contained in the drilling mud. Typically, drilling mud weight is reported in "pounds," short for pounds per gallon. Thus, increasing the weighting of the drilling mud creates a heavier drilling mud.

As used in embodiments disclosed herein, "torque" refers to a force required to rotate the centrifuge for separating solids from fluids in the drilling mud. The torque is supplied to the driving shaft of the centrifuge by a driver, for example, an electrical motor, a gas turbine, or a combustion engine. Where a variable torque is required due to changes in the throughput or the feed weighting characteristics, a torque adjustment device, for example, a gearbox, can be provided.

As used in embodiments disclosed herein, "G force" refers to centrifugal force generated by the rotation of the centrifuge and/or the screw conveyor in response the applied torque. The G force is used in a centrifuge to separate components, such as solids and fluids, based on the relative densities. For example, the heavier solids will accumulate on the outside periphery of the centrifuge chamber, whereas the lighter fluids will accumulate closer to the axis of the centrifuge rotation.

Weighted and un-weighted drilling muds may be efficiently separated using a dual-feed centrifuge according to embodiments disclosed herein. Furthermore, the separation of a drilling mud having a weighting intermediate of a weighted and an un-weighted drilling mud can be optimized using a dual-feed centrifuge according to embodiments disclosed herein.

A dual feed centrifuge according to embodiments disclosed herein may have two separate feed pipes for feeding the drilling mud into the centrifuge. A screw conveyor has a feed port in the form of an opening in its wall located near the outlet end of each feed pipe. As a rotational torque generates G forces inside the centrifuge, the drilling mud in the feed pipe is forced through the feed port into an annular space between the screw conveyor and a bowl for solids separation and recovery.

In one set of embodiments, the entire drilling mud feed may be injected either through the first feed pipe or the second feed pipe, depending on the mud weighting. For example, an un-weighted drilling mud feed may be injected through the first feed pipe into the large bowl section of the centrifuge, where it can undergo premium separation at a low torque. A weighted drilling mud feed may be injected though the second feed pipe into the conical section of the centrifuge, where it can be separated at high throughput rates and a low torque.

In another set of embodiments, the drilling mud feed flow may be allocated between the first feed pipe and the second feed pipe based on the fluid properties. For example, where the solids content of a drilling mud is intermediate that of a weighted mud and an un-weighted mud, the relative flow allocation of the drilling mud between the first and the second feed pipes can be adjusted based on the weighting (density) of the drilling fluid.

Advantageously, one or more embodiments disclosed herein may provide a system and a method for handling high centrifuge feed rates and a varying solids content in the feed.

One or more embodiments disclosed herein may also provide a system and a method to achieve high separation efficiency of the un-weighted drilling muds and high throughput of the weighted drilling muds. Further, embodiments disclosed herein provide a system and a method for processing both weighted and un-weighted drilling muds, thus resulting in equipment costs savings.

One or more embodiments disclosed herein may also provide a system and a method to both achieve the required separation efficiency and to maintain a high feed throughput of a drilling mud having an intermediate weighting.

One or more embodiments disclosed herein may also provide a system and a method to pro-actively adjust the torque loading on the centrifuge and thus reduce the amount of equipment wear and tear.

One or more embodiments disclosed herein may also provide a system and a method to reduce the susceptibility of the centrifuge to solids plugging by adjusting the drilling mud flow between the two feed ports without diminishing the total throughput.

One or more embodiments disclosed herein may also provide a system and a method to increase flexibility of the centrifuge operation by optimizing the profit margin based on the required separation efficiency, throughput, and the costs related to energy consumption, equipment maintenance, and repair based on the centrifuge torque.

For the purpose of illustration and not limitation, various embodiments of the dual-feed centrifuge and the process for separating solids from fluids according to the present disclosure are described below.

Figure 2:
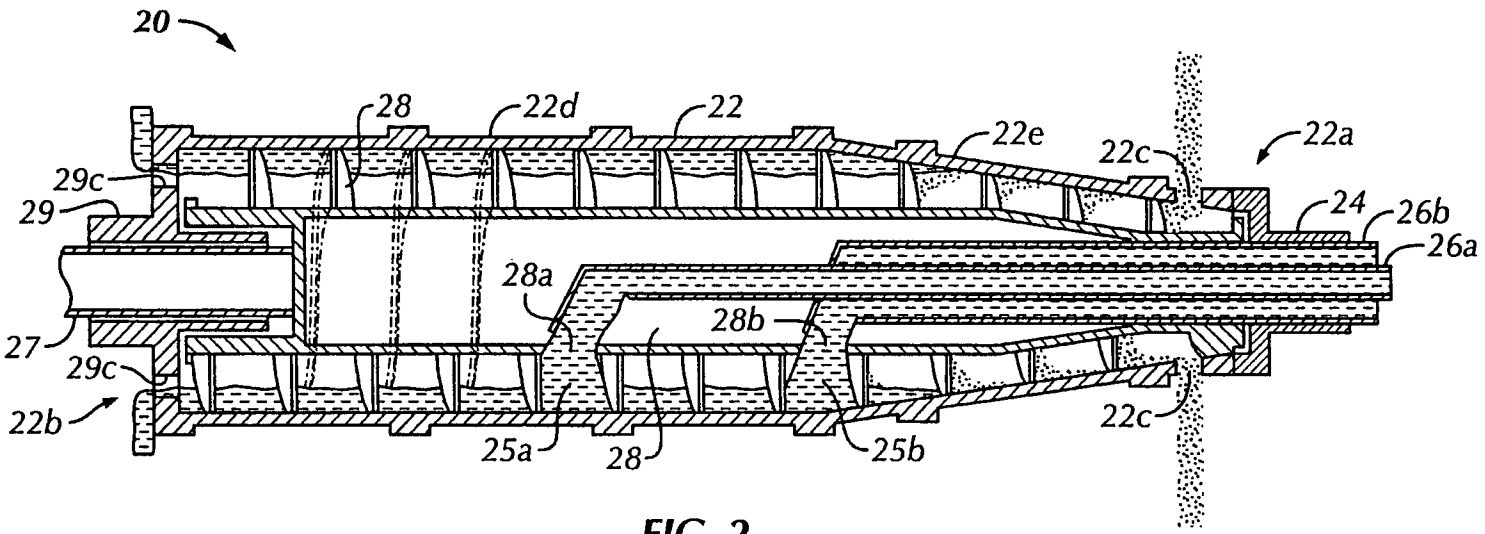
FIG. 2 is a schematic of a dual feed centrifuge system according to embodiments disclosed herein.

Referring to FIG. 2, a dual-feed centrifuge according to one embodiment is illustrated. Centrifuge 20 has a bowl 22, supported for rotation about a longitudinal axis, wherein a large bowl section 22*d* has an open end 22*b*, and a conical section 22*e* has an open end 22*a*, with the open end 22*a* receiving a drive flange 24 which is connected to a drive shaft (not illustrated) for rotating the bowl 22. The drive flange 24 has a single longitudinal passage which receives a first feed pipe 26*a* and a second feed pipe 26*b* for introducing a drilling mud feed into the interior of the bowl 22. A screw conveyor 28 extends within the bowl 22 in a coaxial relationship thereto and is supported for rotation within the bowl 22. A hollow flanged shaft 29 is disposed in the end 22*b* of the bowl and receives a drive shaft 27 of an external planetary gear box for rotating the screw conveyor 28 in the same direction as the bowl 22 at a selected speed.

The wall of the screw conveyor 28 has a first feed port 28*a* proximate the outlet end of the first feed pipe 26*a* and a second feed port 28*b* proximate the outlet of the second feed pipe 26*b*. The centrifugal forces generated by the rotating bowl 22 move the drilling mud in the first feed pipe 26*a* radially outward through the first feed port 28*a* into a first annular space 25*a* between the screw conveyor 28 and the bowl 22 along the large bowl section 22*d* of the centrifuge 20. The centrifugal forces generated by the rotating bowl 22 move the drilling mud in the second feed pipe 26*b* radially outward through the second feed port 28*b* into a second annular space 25*b* between the screw conveyor 28 and the bowl 22 along the conical section 22*e* of the centrifuge 20.

The fluid portion of the drilling mud in both the first annular space 25*a* and the second annular space 25*b* is displaced toward the end 22*b* of the bowl 22 and recovered through one or more fluid discharge ports 29*c*. The entrained solids in the drilling mud accumulate toward the inner surface of the bowl 22 due to the G forces generated, and are scraped and displaced by the screw conveyor 28 toward the end 22*a* of the bowl for discharge through a plurality of solids discharge ports 22*c* formed through the wall of the bowl 22 near its end 22*a*. The centrifuge 20 is enclosed in a housing or casing (not shown) in a conventional manner.

In some embodiments, the first feed pipe 26*a* may be mounted within the second feed pipe 26*b*, commonly referred to as a "double-pipe" arrangement. In other embodiments, the first feed pipe 26*a* and the second feed pipe 26*b* may be mounted side-by-side within the centrifuge. In yet other embodiments, the first feed pipe 26*a* may be an extension of the second feed pipe 26*b*. A person of ordinary skill in the art would recognize that feed pipes of various other shapes and mounting arrangements can also be used.

In some embodiments, the bowl 22 may be of concentric shape. In other embodiments, only a portion of the bowl 22 may have a concentric shape. In yet other embodiments, the large bowl section 22*d* of the bowl 22 may be of concentric shape, whereas the conical section 22*e* of the bowl 22 may be of conical shape. In other embodiments, the diameter of the large bowl section 22*d* is greater than the average diameter of the conical section 22*e*. In other embodiments, the large bowl section 22*d* and the conical section 22*e* may be located proximately along the axial length of the bowl 22.

In some embodiments, the first feed pipe 26*a* may terminate proximate a single feed port, the first feed port 28*a*. In other embodiments, the first feed pipe 26*a* may terminate proximate multiple first feed ports 28*a*. For example, multiple first feed ports 28*a* may be radially spaced along the wall of the screw conveyor 28 with respect the first feed pipe 26*a*. In some embodiments, the axial location of the first feed port 28*a* along the bowl 22 may be approximately in the middle of the large bowl section 22*d*. In other embodiments, the axial location of the first feed port 28*a* along the bowl 22 may be anywhere along the large bowl section 22*d*. In yet other embodiments, the axial location of the first feed port 28*a* along the bowl 22 may be anywhere along the conical section 22*e*.

In some embodiments, the second feed pipe 26*b* may terminate proximate a single feed port, the second feed port 28*b*. In other embodiments, the second feed pipe 26*b* may terminate proximate multiple second feed ports 28*b*. For example, the multiple second feed ports 28*b* may be radially spaced along the wall of the screw conveyor 28 with respect to the second feed pipe 26*b*. In some embodiments, the axial location of the second feed port 28*b* along the bowl 22 may be approximately in the middle of the conical section 22*e*. In other embodiments, the axial location of the second feed port 28*b* along the bowl 22 may be anywhere along the conical section 22*e*. In yet other embodiments, the axial location of the second feed port 28*b* along the bowl 22 may be anywhere along the large bowl section 22*d*.

Figure 3:
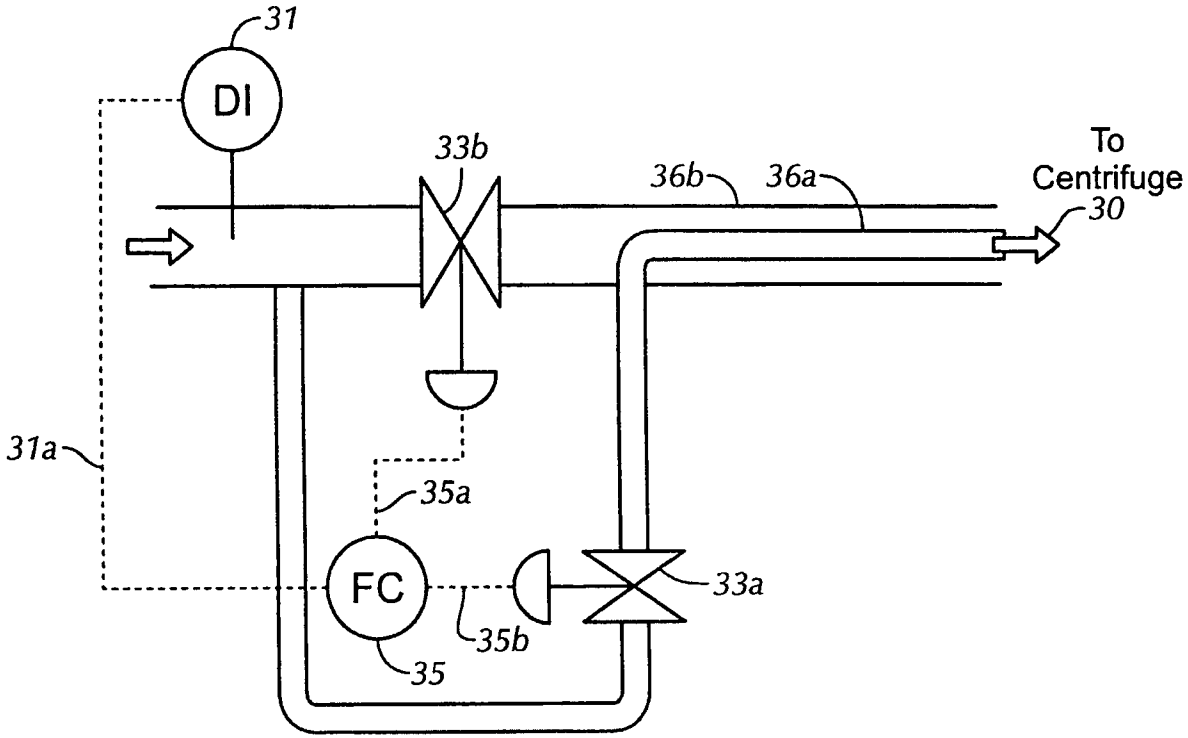
FIG. 3 is a schematic of a control system for a dual feed centrifuge system according to embodiments disclosed herein.

Referring to FIG. 3, a control system for adjusting the drilling mud feed flow to the first feed pipe and the second feed pipe, respectively, is illustrated. A first valve 33*a* fluidly connected to the first feed pipe 36*a* upstream of the centrifuge 30 is used for adjusting the flow of the drilling mud feed to the first feed pipe 36*a*. A second valve 33*b* fluidly connected to the second feed pipe 36*b* upstream of the centrifuge 30 is used for adjusting the flow of the drilling mud feed to the second feed pipe 36*b*. The first feed pipe 36*a* concentrically enters the second feed pipe 36*b* in a "double-pipe" arrangement downstream of the first valve 33*a* and the second valve 33*b*. Both the first feed pipe 36*a* and the second feed pipe 36*b* enter the centrifuge 30 in a concentric ("double-pipe") arrangement.

A density instrument 31, for example, a nuclear, an optical, or a gravity-based density instrument, may be used to measure the density or weighting of the drilling mud upstream of the first valve 33*a* and the second valve 33*b* and produce a density signal 31*a*. The density signal 31*a* may be communicated to a controller 35 that produces a first valve position signal 35*a* and a second valve position signal 35*b*. The first valve position signal 35*a* and the second valve position signal 35*b* are communicated by the controller 35 to the first valve 33*a* and the second valve 33*b*, respectively. Positions of the first valve 33*a* and the second valve 33*b* may be adjusted in response to the first valve position signal 35*a* and the second valve position signal 35*b*, respectively, thus adjusting the flow to at least one of the first feed pipe 36*a* and the second feed pipe 36*b*.

In some embodiments, the first valve 33*a* and the second valve 33*b* may be butterfly control valves. In other embodiments, the first valve 33*a* and the second valve 33*b* may be tight-shut-off ball or globe valves. A person of ordinary skill in the art would recognize that other types of valves or other flow control mechanisms can also be used.

In some embodiments, the controller 35 may be a part of a distributed control system (DCS). In other embodiments, the controller 35 may be a stand-alone field controller, such as a programmable logic controller (PLC). A person of ordinary skill in the art would recognize that other types of flow controllers can also be used.

Figure 4A:
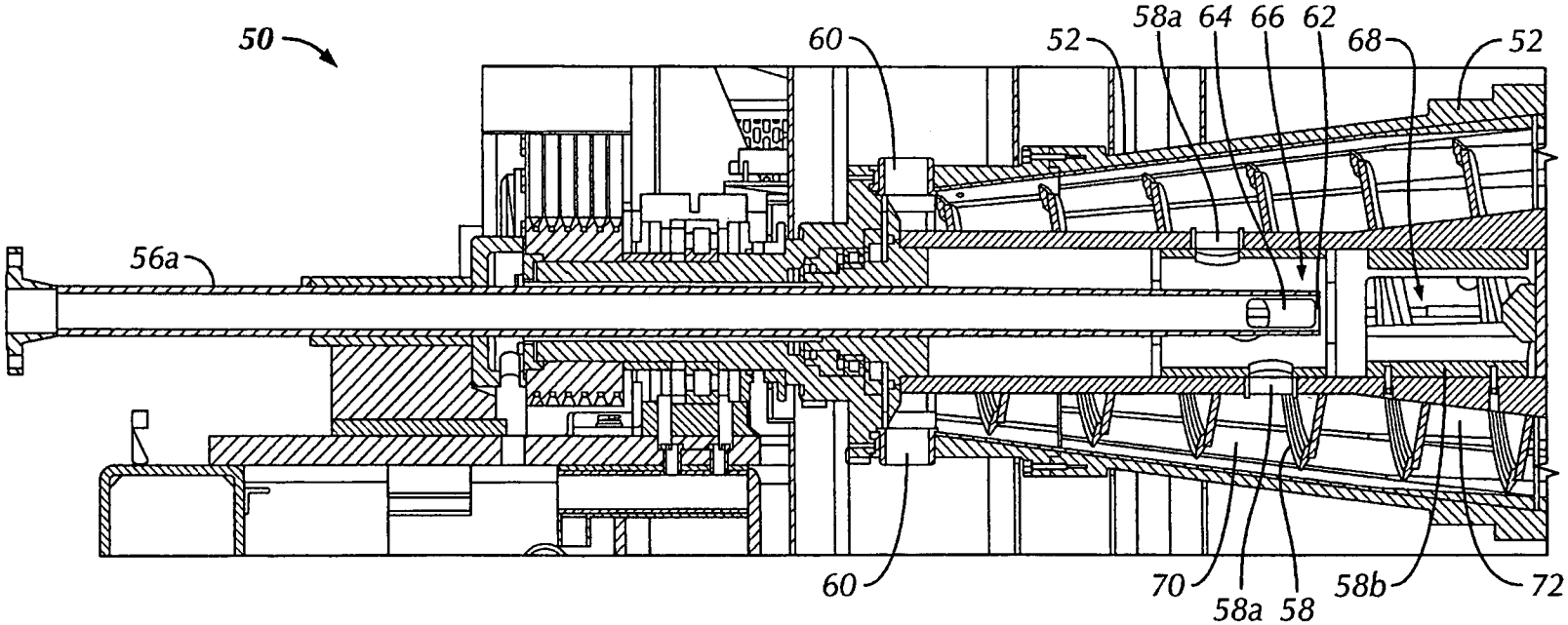
FIG. 4A and FIG. 4B are schematic drawings of a dual feed centrifuge system according to embodiments disclosed herein.
Figure 4B:
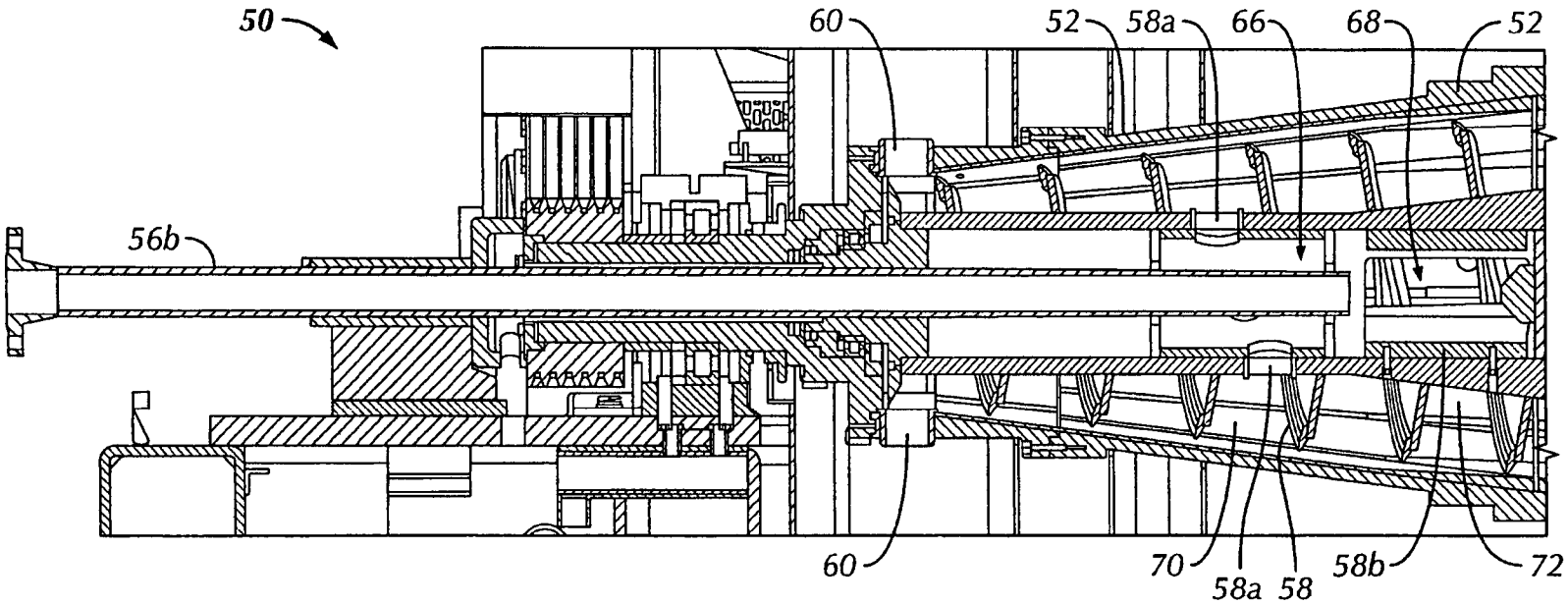

Referring now to FIG. 4A and FIG. 4B, collectively, a dual feed centrifuge system according to embodiments disclosed herein is illustrated. Centrifuge 50 may include a bowl 52, supported for rotation about a longitudinal axis. Bowl 52 includes a conical section 52*e* configured to accept a first feed pipe 56*a* (FIG. 4A) and a second feed pipe 56*b* (FIG. 4B) for introducing a drilling mud feed into the interior of the bowl 52. A screw conveyor 58 extends within the bowl 52 in a coaxial relationship thereto and is supported for rotation within the bowl 52 at a selected speed. The wall of the screw conveyor 58 includes a first feed port or ports 58*a* proximate the outlet end of the first feed pipe 56*a* and a second feed port or ports 58*b* proximate the outlet of the second feed pipe 56*b*. Rotation of the bowl 52 and screw conveyor 58 are similar to that described above with respect to FIG. 2, resulting in the separation of the drilling mud to form a solid fraction and a fluid fraction.

In operation, the first feed pipe 56*a* may be disposed within the centrifuge, such as for separation of a weighted drilling mud. As first feed port 58*a* is located closer to the solid outlets 60 than second feed port 58*b*, the centrifuge will experience less torque than if the weighted drilling mud were fed through second feed port 58*b*. When it is desired to separate an un-weighted drilling mud, first feed pipe 56*a* may be withdrawn from centrifuge 50 and second feed pipe 56*b* may be inserted. In this manner, the benefits of decreased torque may be realized without the need for multiple centrifuges.

First feed pipe 56*a*, in some embodiments, may include a closed or capped end 62 with feed slots 64 proximate capped end 62 for feeding drilling mud radially into feed chamber 66. The capped end 62 may close the opening to feed chamber 68 and the centrifugal forces generated move the drilling mud fed via first feed pipe 56*a* radially outward through first feed port 58*a* into the annular space 70 between the screw conveyor 58 and the bowl 52. When second feed pipe 56*b* is inserted, the centrifugal forces generated by rotating bowl 52 move the drilling mud fed via second feed pipe 56*b* radially outward through second feed port 58*b* into a second annular space 72 between screw conveyor 58 and bowl 52.

As illustrated in FIGS. 4A and 4B, feed ports 58*a* and 58*b* are each open when not in use. However, the centrifugal forces generated prevent accumulation of solids within feed chambers 66, 68, thus plugging of feed ports is not encountered during normal operations.

Additional feed ports and feed pipes may also be used, such as three, four, or more feed ports and pipes to allow greater flexibility with respect to the separations and the resulting torque requirements. Intermediate feed zones may be fed using different length feed pipes having closed or capped ends and radial feed. In this manner, carryover between feed chambers is minimized, thus producing the desired improvements in centrifuge performance.

As described above, embodiments disclosed herein relate to a dual feed centrifuge system and a method for separating and removing solids from liquids in a drilling mud.

Advantageously, a dual feed centrifuge according to one or more embodiments disclosed herein may provide a system and a method for handling high centrifuge feed rates and a varying solids content in the feed.

Advantageously, a dual feed centrifuge according to one or more embodiments disclosed herein can be used to achieve high separation efficiency of the un-weighted drilling muds and high throughput of the weighted drilling muds. Further, a dual-feed centrifuge according the embodiments herein can efficiently process both the weighted and the un-weighted drilling muds, thus resulting in equipment cost savings.

Advantageously, a dual feed centrifuge according to one or more embodiments disclosed herein can also be used to both achieve the required separation efficiency and to maintain a high feed throughput of a drilling mud having an intermediate weighting.

Another advantage of a dual-feed centrifuge according to one or more embodiments disclosed herein over a conventional centrifuge is the ability to pro-actively adjust the torque loading on the centrifuge by allocating the drilling mud flow between the first and the second feed pipes, thus compensating for feed quality-related upsets and reducing the amount of wear and tear on the centrifuge driver and gearbox due to torque adjustments.

Yet another advantage of a dual-feed centrifuge according to one or more embodiments disclosed herein over a conventional centrifuge is the reduced susceptibility to solids plugging. The solids plugging is less likely to occur during a continuous, steady-state operation, and thus by pro-actively adjusting to compensate for feed quality-related upsets or changes in mud weighting, the susceptibility to plugging can be reduced. Further, the solids plugging typically takes place near the narrower, conical section, between the feed port and the solids discharge port. Thus, whereas a conventional centrifuge lacks the ability to reduce the feed flow to the conical section without reducing the total throughput, a dual-feed centrifuge can re-allocate a portion of the feed to the large bowl section in order to avoiding the plugging, without diminishing the total throughput.

A centrifuge experiences the highest conveying resistance, which relates to torque, at the transition from the cylindrical to the conical section due to increased G forces to the solids particles. For recovery of weighting materials, the volume of separated solids is relatively high and causes high torque, restricting the capacity of the centrifuge. By using the first feed port/chamber, which discharges to the conical section, the transition area is avoided and therefore reduced torque is encountered, allowing higher feed rate capacities than typical centrifuges.

Yet another advantage of a dual-feed centrifuge according to one or more embodiments disclosed herein over a conventional centrifuge is the increased flexibility of operation. For example, the centrifuge operation can be optimized by taking into account the profit margins based on the required separation efficiency, throughput, and the costs related to energy consumption, equipment maintenance, and repair based on the centrifuge torque.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A dual feed centrifuge system for separating solids from fluids in a drilling mud, the centrifuge system comprising:

a bowl having a bowl section and a conical section;

a screw conveyor rotatably mounted within the bowl;

a first feed pipe mounted within the screw conveyor for feeding a drilling mud through a first feed port in a wall of the screw conveyor to a first annular space between the bowl and the wall of the screw conveyor, wherein the first feed port is located approximately midway axially along the conical section; and a second feed pipe mounted within the screw conveyor for feeding a drilling mud through a second feed port in the wall of the screw conveyor to a second annular space between the bowl and the wall of the screw conveyor, wherein the second feed port is located approximately midway axially along the bowl section.

2. The dual feed centrifuge system of claim 1, wherein the first feed pipe is mounted within the second feed pipe.

3. The dual feed centrifuge system of claim 1, the conical section further comprising a solid discharge port for recovering solids from the conical section of the bowl.

4. The dual feed centrifuge system of claim 1, the bowl section further comprising a fluid discharge port for recovering fluids.

5. The dual feed centrifuge system of claim 1, comprising two or more first feed ports located radially along the wall of the screw conveyor with respect to the first feed pipe.

6. The dual feed centrifuge system of claim 1, comprising two or more second feed ports located radially along the wall of the screw conveyor with respect to the second feed pipe.

7. The dual feed centrifuge system of claim 1, further comprising a system for controlling a flow of the drilling mud through at least one of the first feed pipe and the second feed pipe.

8. The dual feed centrifuge system of claim 7, the system for controlling a flow comprising at least one valve for adjusting the flow of the drilling mud through at least one of the first pipe and the second pipe.

9. The dual feed centrifuge system of claim 8, further comprising a density instrument for measuring at least one of a density and a weighting of the drilling mud.

10. The dual feed centrifuge system of claim 9, the system for controlling a flow further comprising a controller for manipulating a position of the at least one valve in response to the measured density.

11. The dual feed centrifuge system of claim 10, the control system further comprising:

a communication device for sending the at least one of a measured density value and a weighting value to a controller; and a communication device for sending the valve position signal from the controller to the at least one valve.

12. A process for separating solids from fluids in a drilling mud comprising:

feeding a drilling mud through at least one of a first feed pipe and a second feed pipe to a centrifuge, the centrifuge comprising:

a bowl supported for rotation about a longitudinal axis, the bowl having a first end, a second end, a bowl section proximate the first end and a conical section proximate the second end;

a screw conveyor rotatably mounted within the bowl and in a co-axial relationship with the bowl;

a first feed pipe mounted within the screw conveyor for feeding a drilling mud through a first feed port in a wall of the screw conveyor to a first annular space between the bowl and the wall of the screw conveyor, wherein the first feed port is located approximately midway along the longitudinal axis of the conical section; and a second feed pipe mounted within the screw conveyor for feeding a drilling mud through a second feed port in the wall of the screw conveyor to a second annular space between the bowl and the wall of the screw conveyor, wherein the second feed port is located approximately midway axially along the longitudinal axis of the bowl section;

separating the drilling mud into a solid and a fluid, the separating comprising:

rotating the bowl with a speed A using a rotation device, wherein the solid accumulates along the bowl;

rotating the screw conveyor with a speed B using a rotating device, wherein the fluid moves along the screw conveyor;

moving the solid along the bowl using the screw conveyor;

recovering the solid through a solid discharge port proximate the second end of the bowl; and recovering the fluid through a fluid discharge port proximate the first end of the bowl.

13. The process of claim 12, further comprising adjusting a flow of the drilling mud in at least one of the first feed pipe and the second feed pipe in response to a change of at least one of a flow rate, a density, and a weighting of the drilling mud.

14. The process of claim 12, wherein the first feed pipe is mounted within the second feed pipe.

15. The process of claim 12, wherein the drilling mud is a weighted drilling mud.

16. The process of claim 12, wherein the drilling mud is an un-weighted drilling mud.

17. A method for separating solids from fluids, the method comprising:

feeding a first drilling mud via a first feed pipe to the centrifuge approximately midway axially along the conical section, the centrifuge comprising:

a bowl;

a screw conveyor rotatably mounted within the bowl;

a first feed port in a wall of the screw conveyor; and a second feed port in the wall of the screw conveyor;

wherein the first feed pipe is mounted within the screw conveyor for feeding the drilling mud through the first feed port to an annular space between the bowl and the wall of the screw conveyor; and feeding a second drilling mud via a second feed pipe to the centrifuge approximately midway axially along the bowl section, wherein the second feed pipe is mounted within the screw conveyor for feeding the drilling mud through the second feed port to the annular space between the bowl and the wall of the screw conveyor.

18. The method of claim 17, wherein the first feed pipe is mounted within the second feed pipe.

19. The method of claim 17, further comprising:

withdrawing the first feed pipe from the centrifuge;

inserting the second feed pipe within the centrifuge.

20. The method of claim 19, further comprising:

separating the first drilling mud into a first solid fraction and a first fluid fraction, the separating comprising:

rotating the bowl with a speed A using a rotation device, wherein the first solid fraction accumulates along the bowl;

rotating the screw conveyor with a speed B using a rotating device, wherein the first fluid fraction moves along the screw conveyor;

moving the first solid fraction along the bowl using the screw conveyor;

recovering the first solid fraction through a solid discharge port; and recovering the first fluid fraction through a fluid discharge port.

21. The method of claim 20, further comprising:

separating the second drilling mud into a second solid fraction and a second fluid fraction, the separating comprising:

rotating the bowl with a speed A using a rotation device, wherein the second solid fraction accumulates along the bowl;

rotating the screw conveyor with a speed B using a rotating device, wherein the second fluid fraction moves along the screw conveyor;

moving the second solid fraction along the bowl using the screw conveyor;

recovering the second solid fraction through a solid discharge port; and recovering the second fluid fraction through a fluid discharge port.

22. The method of claim 17:

the first drilling mud comprises a weighted drilling mud; and the second drilling mud comprises an un-weighted drilling mud.

23. A dual feed centrifuge system for separating solids from fluids in a drilling mud, the centrifuge system comprising:

a bowl having a bowl section and a conical section;

a screw conveyor rotatably mounted within the bowl;

a first feed pipe mountable within the screw conveyor for feeding a drilling mud through a first feed port in a wall of the screw conveyor to a first annular space between the bowl and the wall of the screw conveyor, wherein the first feed port is located approximately midway along the longitudinal axis of the conical section; and a second feed pipe mountable within the screw conveyor for feeding a drilling mud through a second feed port in the wall of the screw conveyor to a second annular space between the bowl and the wall of the screw conveyor, wherein the second feed port is located approximately midway axially along the bowl section.

* * * * *